US006161687A

United States Patent [19]

Hacikyan

[11] Patent Number: 6,161,687

[45] Date of Patent: Dec. 19, 2000

[54] VIAL CONTAINER

[75] Inventor: Mike Hacikyan, Buffalo, N.Y.

[73] Assignee: Technicor, Inc., Amherst, N.Y.

[21] Appl. No.: 09/343,901

[22] Filed: Jun. 30, 1999

Related U.S. Application Data

[63] Continuation-in-part of application No. 09/247,421, Feb. 10, 1999, Pat. No. 5,984,087.

[51] Int. Cl.[7] ..... B65D 65/38

[52] U.S. Cl. ..... 206/204; 206/484; 383/109

[58] Field of Search ..... 206/204, 484, 206/484.2, 524.7; 383/109, 113

[56] References Cited

U.S. PATENT DOCUMENTS 5,833,058 11/1998 Mabry ..... 206/204

*Primary Examiner*—Jacob K. Ackun

*Attorney, Agent, or Firm*—Hodgson Russ Andrews Woods & Goodyear LLP

[57] ABSTRACT

The present invention relates to a packaging container designed to transport an inner container containing a liquid. The packaging container has at least one sealing multi-layer comprising a first water soluble film and an absorbent material. The inner layer of the packaging container is the water-soluble film that forms the boundary between the cavity that hold the inner container and the packaging container. When the liquid leaks from the inner container while in the packaging container, the liquid passes through the water-soluble film. When the liquid contacts the absorbent material, the absorbent material absorbs and immobilizes the liquid material. This immobilization prevents the liquid from escaping from the packaging container. The present invention also includes a security feature, an apparatus to identify where or whom the liquid was obtained from and/or tests to be conducted, and/or the ability to extract the liquid from the absorbent material.

16 Claims, 4 Drawing Sheets

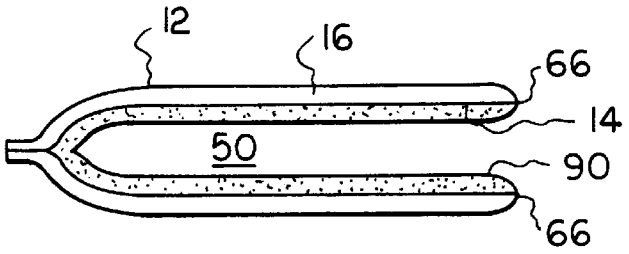
FIG. 2
FIG. 3
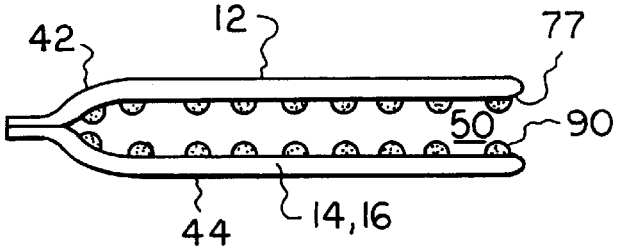
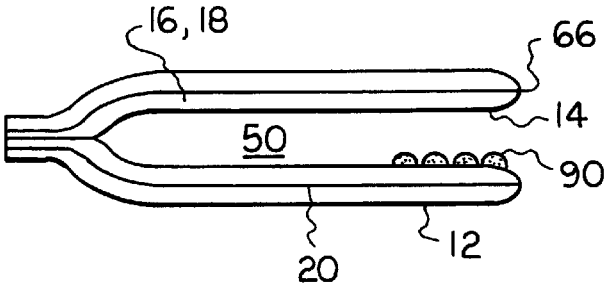
FIG. 4
FIG. 5
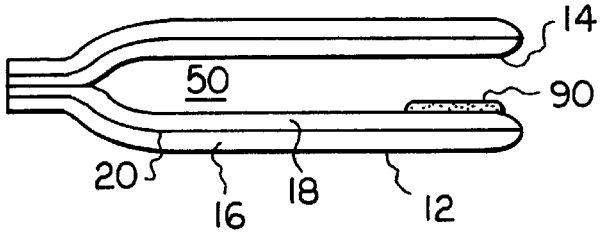
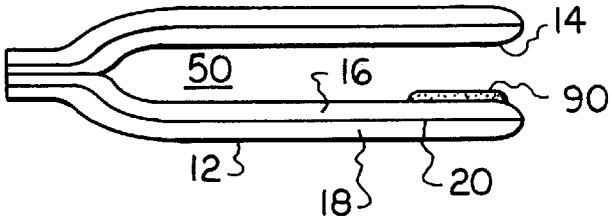
FIG. 6

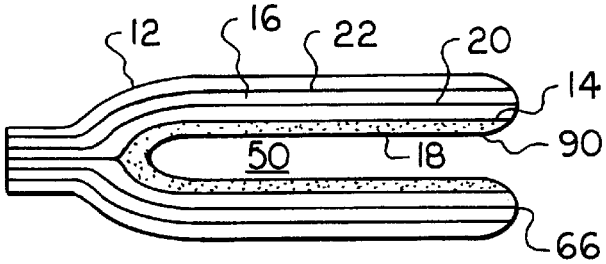
FIG. 7
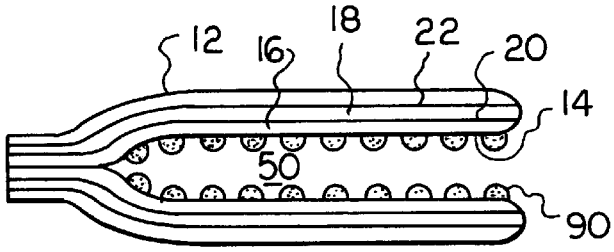
FIG. 8
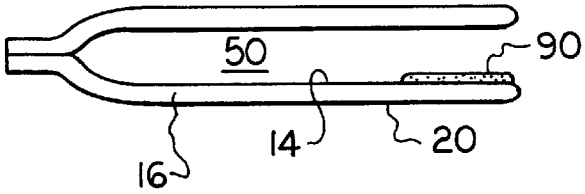
FIG. 9
FIG. 10
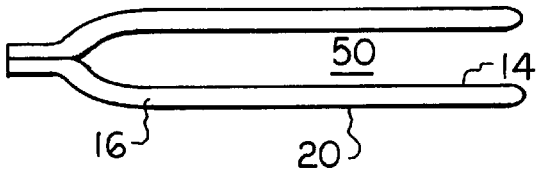
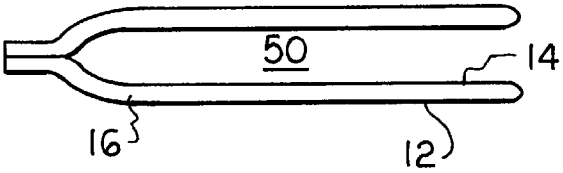
FIG. 11

VIAL CONTAINER

PRIORITY OF INVENTION

This application is a continuation-in-part application of U.S. patent application Ser. No. 09/247,421, filed Feb. 10, 1999 and now U.S. Pat. No. 5,984,087.

FIELD OF THE INVENTION

The present invention is a packaging container that holds a liquid contained within an inner container. And when the material leaks from the inner container, the package container ensures the material does not leak therefrom.

BACKGROUND OF THE INVENTION

Prior attempts to control leaking materials have been disclosed in U.S. Pat. No. 4,749,600 (Inventors: Cullen et al.). Cullen et al. disclose a packet for absorbing and immobilizing a liquid. The packet looks like a sugar packet (See FIG. 3 of the '600 patent) by having an outer layer and inner contents. When the packet is to be used, it is inserted within an outer container, like a Federal Express package. In most instances, the packet falls to the bottom edge, in particular a corner, of the outer container. See Col. 2, lines 46 of the '600 patent. Along with the packet, an inner container of a liquid, like a test-tube of blood (See FIG. 5 of the '600 patent) is inserted into the outer container. According to the '600 patent, the bottom edge of the inner container should contact the packet. Thus, when the blood spills from the inner container, the blood may contact the packet.

If the blood contacts the packet, the blood dissolves the outer layer. The packet has an inner layer of polyvinyl acetate and an outer layer of starch paper or any other liquid-degradable material. The polyvinyl acetate has to be the inner layer in order for the packet to be formed. See col 2, lines 9–11 of the '600 patent.

When the outer layer dissolves, the inner contents are released and form a gel-like substance by absorbing the blood. The inner content is sodium polyacrylate having the formula $(C_3H_3O_2Na)_n$. It is obtainable under the trademark WATER LOCK J-550 from Grain Processing Corporation.

A problem with the Cullen et al. attempt to immobilize a liquid, is that the packet is so small that it is possible that the liquid may never contact the packet. For example, if the packet is located at the bottom of the outer container, as Cullen et al. suggest, and the liquid leaks to the top of the outer container, the packet will never immobilize the liquid since the liquid never contacts the packet. Thereby, the liquid spills from the outer container and provides little protection to the handler of the package. These results could be extremely deleterious to the handler. For example, if the liquid is HIV contaminated and that liquid contacts a cut on the handler, that handler could become infected. This problem is solved by the present invention.

SUMMARY OF THE INVENTION

The present invention relates to a packaging container designed to transport an inner container containing a liquid. The packaging container has at least one sealing multi-layer comprising a first water soluble film and an absorbent material. The inner layer of the packaging container is the water-soluble film that forms the boundary between the cavity that hold the inner container and the packaging container. When the liquid leaks from the inner container while in the packaging container, the liquid passes through the water-soluble film. When the liquid contacts the absorbent material, the absorbent material absorbs and immobilizes the liquid material. This immobilization prevents the liquid from escaping from the packaging container. The present invention also includes a security feature, an apparatus to identify where or whom the liquid was obtained from and/or tests to be conducted, and/or the ability to extract the liquid from the absorbent material.

BRIEF DESCRIPTION OF THE DRAWINGS

FIG. 2 is a cross-sectional view of FIG. 1 taken along the line 2—2.

FIGS. 3 to 11 are alternative embodiments of FIG. 2.

DETAILED DESCRIPTION OF THE PRESENT INVENTION

Figure 1:
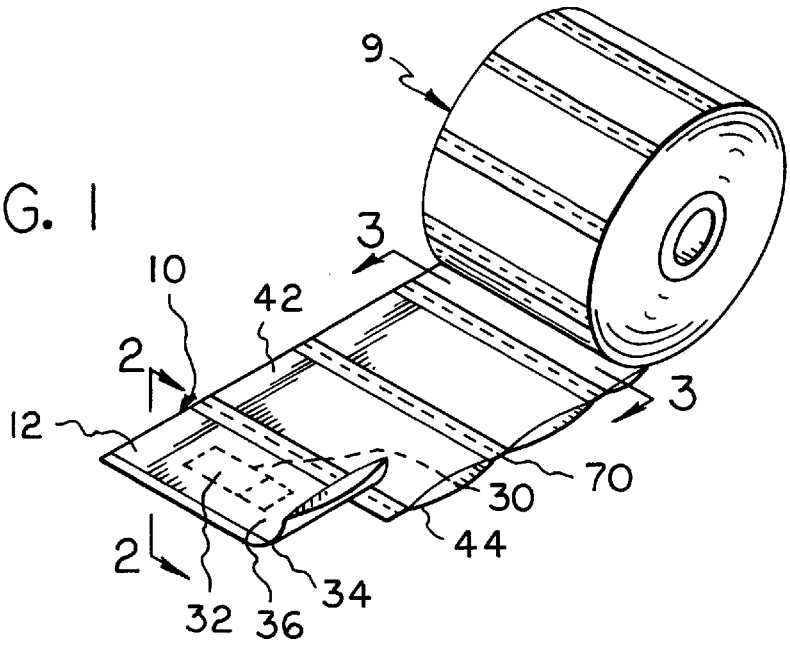
FIG. 1 is a perspective view of a plurality of packaging containers.

One version of the packaging container 10 for adsorbing and immobilizing a liquid 32 is shown at FIG. 1 in a roll 9 having a plurality of containers 10. Each container 10 includes a multi-layer film wherein the outer layer 12 is shown. The outer layer 12 is any suitable material such as paper, cardboard, wood, or plastic, but preferably a water-insoluble material. Examples of some water-insoluble materials that can be used for the outer layer 12 include thermoplastic resin films, laminated films prepared from two or more thermoplastic resin films, and laminated films prepared from a thermoplastic resin film and paper, metallic foil, woven fabric or unwoven fabric. Preferable thermoplastic resins include polymers and copolymers of olefins, such as ethylene, propylene, butene, pentene, hexene, and the like; polymers and copolymers of vinyl compounds such as vinyl chloride, vinylidene chloride, vinylacetate, vinyl alcohol, acrylic ester, methacrylic ester, acrylonitrile, styrene and the like, polymers of diolefins such as butadiene, isoprene, and the like; copolymers of the above-mentioned olefins, or vinyl compounds; polyamides; and polyesters such as polyethylene terephthalate and the like.

Figure 12:
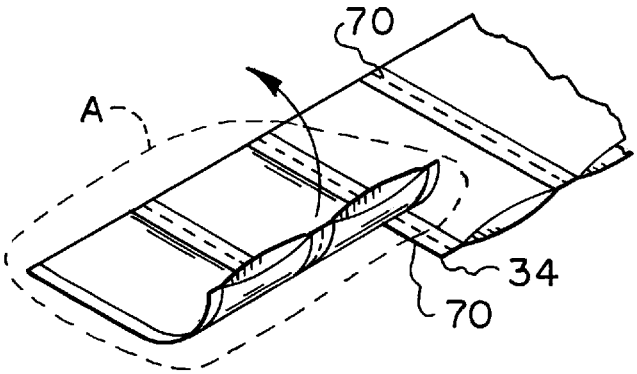
FIG. 12 is a view of FIG. 1 taken along the line 3—3.
Figure 13:
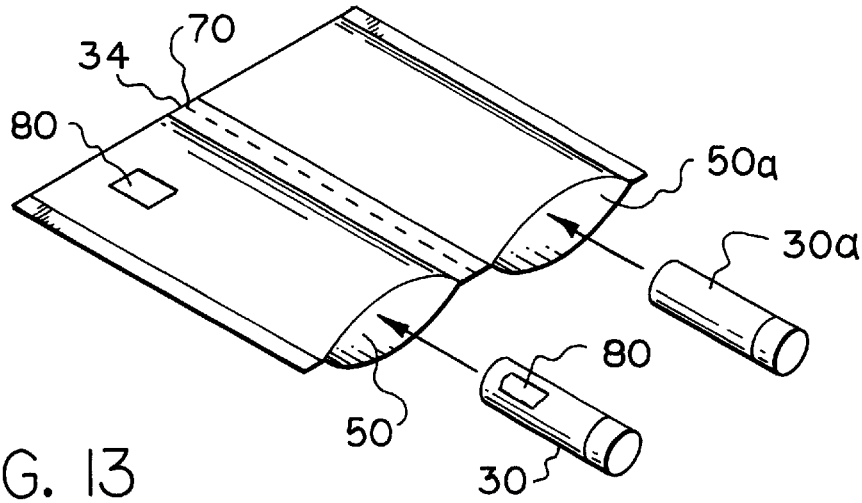
FIG. 13 shows Section A of FIG. 12.
Figure 14:
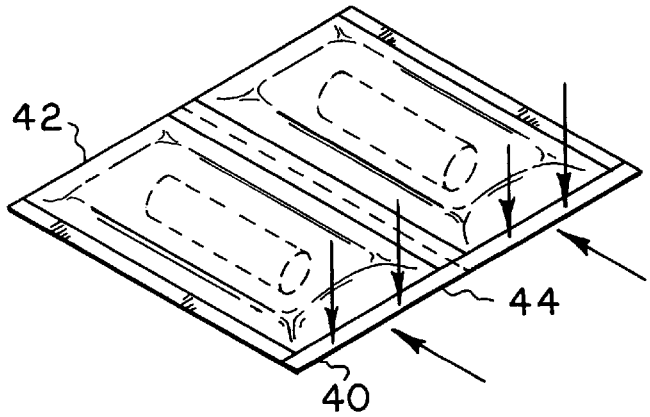
FIGS. 14 to 15 are alternative embodiments of FIG. 13.
Figure 15:
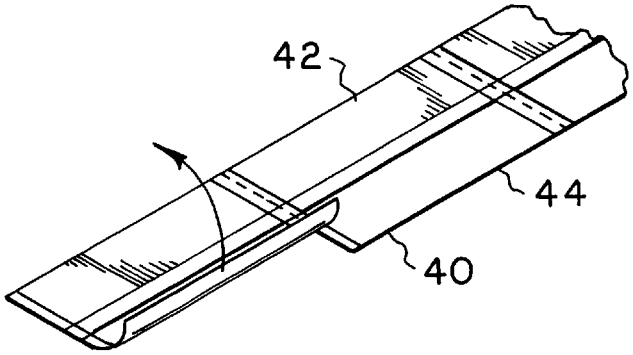

The container 10 has at least two sides—a top side 42 and a bottom side 44. The bottom side 44 is either the same length as the top side 42, as shown in FIG. 1, or longer than the top side 42, as shown in FIGS. 14 and 15, so the bottom side 44 has a flap 40. The flap 40 is designed to fold over onto a portion of the top side 42, as shown in FIGS. 12–13. The inner layer of the flap 40 contacts the top side 42 by various conventional methods. One method, which is shown in FIGS. 2–9, has a conventional sealant material 90. Such sealant materials 90 include polyvinyl acetate, ethylvinyl acetate or glue. These sealant materials 90 can be film-like as shown in FIG. 2 or a dot matric coating as shown in FIG. 3. In either case, these sealant materials 90 adhere to the top side 42 or underside of the topside 77 by conventional sealing processes, such as crimping, adhesive, pressure sealing, or heat sealing to ensure the package 10 is tamper resistant and impact resistant.

Figure 16:
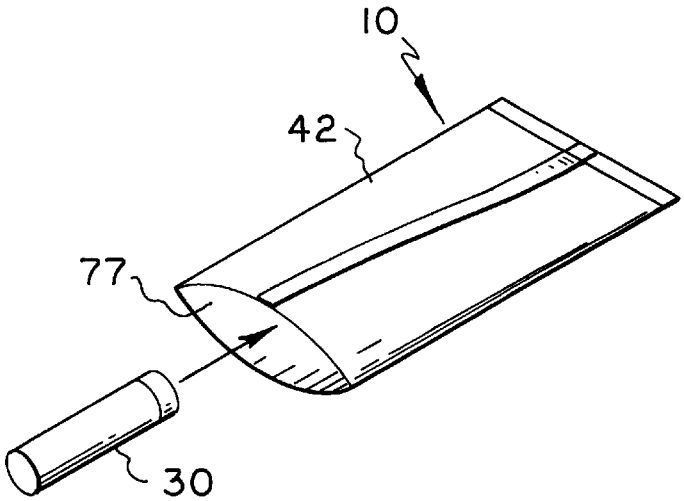
FIGS. 16 to 17 are alternative embodiments of FIG. 2.
Figure 17:
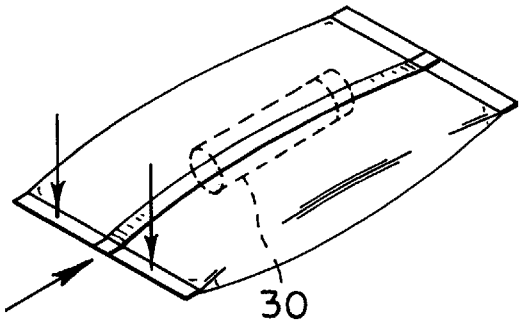

Another method to seal the package container 10, and make it tamper resistant and impact resistant, is merely heat sealing or pressure sealing the edges of the package 10 together with a tab 40 as shown in FIGS. 14–15, or without a tab 40 as shown in FIGS. 16–17.

The packaging container 10 is used to transport liquids or gelatin materials, hereinafter liquid material 32, from one place to another. The liquid material 32 can be a biological, a radioactive, a pesticide, and/or a chemical agent.

A vial 30 contains the liquid 32. The vial 30 is any type of container that can securely hold the liquid material 32 and fit within the container 10. The vial 30 can be a rigid material such as glass, metallic, ceramic, plastic or the like, or a flexible material like a conventional flexible plastic material. The vial 30 should be sealable for transportation purposes. An example of the seal includes a cap 36 which holds the liquid 32 sealed within the vial 30. Sometimes, the liquid 32 leaks from the vial 30. When this occurs, the inner layer of the container 10 controls the leaking.

Turning to FIG. 2, the container 10 has the outer layer 12, a cavity 50 to hold the vial 30, an absorbent material 16, and a first layer of a water-permeable material 14. The layers 12 and 14 are superimposed upon each other and seal together at the peripheral edges 66 of the container 10. At the peripheral edges 66, the layers 12, 14 are sealed together by conventional methods, such as heat sealing, pressure sealing, crimping, and/or adhesive. Between layers 12, 14 is the absorbent material 16. The absorbent material 16 is contained within the two layers 12, 14 until the liquid permeates through the first layer 14, which can dissolve.

The first layer 14 is any conventional water permeable material, such as starch paper, polyvinyl acetate, water-soluble synthetic polymer films, water soluble semisynthetic polymer films, and water-soluble natural polymers. Examples of water soluble synthetic polymer films include partially saponified polyvinyl alcohol, polyethers, such as polyethylene oxide and the like, polyvinylpyrrolidone, ethylenically unsaturated acids, such as acrylic acid, methacrylic acid, maleic acid, and polymers formed from their salts thereof.

Examples of water soluble semisynthetic polymer films include cellulose derivatives, such as carboxymethyl cellulose, hydroxyethyl cellulose, hydroxypropyl cellulose, and starch derivatives such as cyclodextrin. As for the water-soluble natural polymers, those include carrageena, starch, gelatin, and chitin.

Layer 14 can also be conventional non-woven and/or woven materials of plastic, natural products, namely, wool or cotton, or synthetic materials. In this embodiment, the layer 14 positions the absorbent material 16 and allows liquid 32 to penetrate through it.

In any case, liquid 32 passes through layer 14 when liquid 32 contacts it. The absorbent material 16 is then released. When released, the material 16 absorbs or immobilizes large volumes of aqueous solutions including dilute alkalis, dilute acids and body fluids. The material is sodium polyacrylate having the formula $(C_3H_3O_2Na)_n$ and variations thereof. It is obtainable under the trademark WATER LOCK J-550 from Grain Processing Corporation.

In some instances, it is desirable to add a conventional nullifying agent 18, such as a biocide or equivalent thereof, to nullify a specific undesirable quality of the liquid 32. In some instances, it is desirable to mix the absorbent material 16 and nullifying agent 18 together as shown in FIG. 3.

In another embodiment of the present invention, a second water permeable material 20 is located between the first layer 14 and the outer layer 12. The second layer 20 is selected from the same group of materials as the first layer 14. Moreover, the first layer 14 superimposes upon the second layer 20 and the outer layer 12, wherein each layer 12, 14, 20 seals together at the peripheral edges 66. As shown in FIG. 4, the absorbent material 16 and nullifying agent 18 are mixed together between the first and second layers 14, 20, or alternatively, either the absorbent material 16 or the nullifying agent 18 are between the first and second layers 14,20.

To ensure safe transport of the liquid 32, sometimes it is advisable to separate the two materials 16, 18. In FIG. 5, the nullifying agent 18 is between the first layer 14 and the second layer 16 while the absorbent material 16 is between the second layer 16 and the outer layer 12. In contrast, FIG. 6 shows the opposite configuration of FIG. 5.

In yet another embodiment of the present invention, FIGS. 7 and 8 illustrate a variation of FIGS. 5 and 6 respectively. The only difference between these figures is that FIGS. 7 and 8 both illustrate a third water permeable material 22. The third layer 22 is selected from the same group of materials as the first layer 14. Moreover, the first layer 14 superimposes upon the second layer 20, third layer 22, and outer layer 12, wherein each layer 12, 14, 22, 20 seals together at the peripheral edges 66.

Another embodiment of the present invention is illustrated in FIG. 9. FIG. 9 illustrates FIG. 4 without the water insoluble layer 12. Obviously, as indicated by FIG. 9, alternative embodiments of the present invention also include those embodiments shown in FIGS. 4–8 without the water insoluble layer 22.

Likewise, FIGS. 10 and 11 respectively illustrate embodiments of FIGS. 2 and 9 without any sealing material 90. Obviously, as indicated by FIGS. 10 and 11, alternative embodiments of the present invention also include those embodiments illustrated in FIGS. 38.

Turning to FIG. 12, packages 10 can be removed from roll 9 in sets or individually, as shown in FIG. 9, along perforations 70. Thereby, the user can select the desired number of packages 10 to be transported.

Turning to FIGS. 13 and 16, vials 30 are inserted into cavity 50, preferably within an air pocket therein to provide further protection. The air pocket can be incorporated within cavity 50 by a conventional blower. The blower pumps the air into the cavity 50 to form the air pocket. The air pocket forms within the cavity 50 only after the package 10 is sealed as shown in FIGS. 15 and 17.

Alternatively, the package 10 can have a security feature 80. The security feature 80 can be a bar code system or illustrate the fingerprint, handprint, or thumbprint of the person who supplied the liquid 32 and/or who obtained the liquid 32. Preferably, the security feature 80 is positioned on the outer layer, 12, 22, or 20 of the package 10, on the vial 30, or both.

The security feature 80 can also be an identification feature, which identifies the type of test to be conducted on the liquid 32; and/or identifies who supplied the liquid 32 or where the liquid 32 came from.

Another alternative to the identification system can be a color code system. A particular color on the outer layer 12, 22, 20 of the package 10, the vial, 30, or both which identifies which test should be conducted on the liquid 32. The color can cover the entire outer layer 12, 22, 20, the vial 30, or both or just a portion thereof.

In case the absorbent material 16 is activated and absorbs the liquid 32, the liquid 32 can be extracted from the absorbent material 16, and the nullifying agent 18. The extraction can be accomplished by conventional biological processes, for example, osmosis, chemical processes, or mechanical processes, i.e., centrifugation. Thereby, the liquid 32 can be analyzed whether the vial 30 is broken or not.

In yet another embodiment of the present invention shown at FIG. 13, the package container 10 can be divided into having at least two cavities 50, 50*a* to hold two vials 30, 30*a*. The container 10 is divided, not always equally, along edge 34 and perforations 70. Edge 34 is formed in the same manner as the various layers of container 10 are joined at peripheral edge 66.

The present invention 10 ensures that if for any reason liquid 32 leaks from vial 30, the liquid 32 will permeate, and dissolve in some instances, at least a portion of the first layer 14 because the first layer 14, and obviously the absorbent material 16 and/or nullifying agent 18, completely surrounds the vial 30. And once the liquid passes through the first layer 14, the enclosed agent, either 16 and/or 18, will nullify or absorb the liquid 32. Thereby, the handler of the packaging container 10 will know that no liquid 32 will accidently leak from it.

While preferred embodiments of the present invention have been disclosed, it will be appreciated that it is not limited thereto but may be otherwise embodied with the scope of the following claims.

What is claimed is:

1. A packaging container comprising at least one sealable multi-layer film having at least a first layer of a water permeable material and a second layer of a water permeable material, wherein the inner layer of the packaging container is the first water permeable material and the outer layer of the packaging container is the second water permeable material, the first and second water permeable materials are superimposed and bonded to each other at the peripheral edges of each film, each water permeable material allows a liquid to penetrate through the water permeable material when a liquid material contained in a vial leaks within the packaging container;

a cavity within the packaging container to hold the vial wherein the boundary between the cavity and the packaging container is the first water permeable material; and an absorbent material between the first and second water permeable materials that absorbs and immobilizes the liquid material, so the liquid material is prevented from leaking from the packaging container.

2. The packaging container of claim 1 further comprising a water insoluble material that encloses the container, the container becomes tamper-resistant.

3. The packaging container of claim 1 further comprising a nullifying material for additionally treating the liquid material to nullify a specific undesirable quality thereof.

4. The packaging container of claim 1 wherein the nullifying material is mixed with the absorbent material.

5. The packaging container of claim 1 comprising a third water soluble film superimposed between the first and second water permeable materials and bonded at the peripheral edges of each water permeable material.

6. The packaging container of claim 5 further comprising a nullifying material for additionally treating the liquid material to nullify a specific undesirable quality thereof, the nullifying material is between the first and third water permeable materials, and the absorbent material is between the third and second water permeable materials.

7. The packaging container of claim 5 further comprising a nullifying material for additionally treating the liquid material to nullify a specific undesirable quality thereof, the nullifying material is between the second and third water permeable materials, and the absorbent material is between the third and first water permeable materials.

8. The packaging container of claim 5 wherein the absorbent material is between the second and third water permeable materials.

9. The packaging container of claim 5 wherein the absorbent material is between the first and third water permeable materials.

10. The packaging container of claim 1 wherein the inner layer of the first water permeable material has a sealant material.

11. The packaging container of claim 1 wherein the inner layer of the second water permeable material has a sealant material.

12. The packaging container of claim 5 wherein the inner layer of the third water permeable material has a sealant material.

13. The packaging container of claim 1 further comprising a security device.

14. The packing container of claim 1 further comprising an identification device.

15. The packaging container of claim 1 further comprising a security device.

16. The packing container of claim 1 further comprising an identification device.

* * * * *